US006809911B2

(12) United States Patent
Dickhoff et al.

(10) Patent No.: US 6,809,911 B2
(45) Date of Patent: Oct. 26, 2004

(54) SAFETY SWITCHING DEVICE FOR SAFELY SWITCHING OFF AN ELECTRICAL LOAD

(75) Inventors: Rolf Dickhoff, Kirchheim (DE); Winfried Gräf, Esslingen am Neckar (DE)

(73) Assignee: Pilz GmbH & Co., Ostfildern (DE)

( * ) Notice: Subject to any disclaimer, the term of this patent is extended or adjusted under 35 U.S.C. 154(b) by 0 days.

(21) Appl. No.: 10/355,703

(22) Filed: Jan. 31, 2003

(65) Prior Publication Data

US 2003/0137788 A1 Jul. 24, 2003

Related U.S. Application Data

(63) Continuation of application No. PCT/EP01/08805, filed on Jul. 30, 2001.

(30) Foreign Application Priority Data

Aug. 1, 2000 (DE) ..... 100 37 383

(51) Int. Cl.[7] ..... H02H 9/00
(52) U.S. Cl. ..... 361/23; 361/115
(58) Field of Search ..... 361/54, 23, 28, 361/115, 29

(56) References Cited

U.S. PATENT DOCUMENTS 4,053,876 A * 10/1977 Taylor ..... 340/529
4,068,773 A * 1/1978 Downing et al. ..... 214/674
4,085,823 A * 4/1978 Caputo et al. ..... 187/293
4,769,555 A * 9/1988 Pequet et al. ..... 307/141
5,406,442 A 4/1995 Kristensen
5,956,218 A * 9/1999 Berthold ..... 361/42
2001/0002101 A1 5/2001 Magnussen

FOREIGN PATENT DOCUMENTS

| | | |
|---|---|---|
| DE | 3642 233 A1 | 6/1988 |
| DE | 40 33 800 A1 | 4/1992 |
| DE | 44 41 171 C1 | 2/1996 |
| EP | 0 608 477 A2 | 8/1994 |
| WO | WO 99/63561 | 12/1999 |

* cited by examiner

*Primary Examiner*—Brian Sircus
*Assistant Examiner*—Zeev Kitov
(74) *Attorney, Agent, or Firm*—Harness, Dickey & Pierce, P.L.C.

(57) ABSTRACT

The present invention relates to a safety switching device for safely switching off an electrical load such as an electrically driven machine. The safety switching device has a failsafe disconnection unit and a non-failsafe signaling unit, both of which are supplied with an external control signal. The disconnection unit fail-safely switches off the electrical load as a function of the control signal but with a first delay. The signaling unit produces an external reporting signal as a function of the control signal in a non-delayed and non-failsafe manner.

16 Claims, 5 Drawing Sheets

SAFETY SWITCHING DEVICE FOR SAFELY SWITCHING OFF AN ELECTRICAL LOAD

CROSS-REFERENCES TO RELATED APPLICATIONS

This application is a continuation of copending international patent application PCT/EP01/08805 filed on Jul. 30, 2001 and designating the U.S., which claims priority from German patent application DE 100 37 383.6, filed on Aug. 1, 2000.

BACKGROUND OF THE INVENTION

The present invention relates to a safety switching device for safely switching off an electrical load such as an electrically driven machine. The invention relates in particular to a safety switching device having a failsafe disconnection unit as well as a signaling unit, to both of which an external control signal is jointly supplied. The disconnection unit switches off the electrical load in a failsafe manner as a function of a defined signal state of the control signal, and the signaling unit produces an external reporting signal as a function of the defined signal state.

Safety switching devices like this are particularly used in industrial areas in order to carry out disconnection processes in a failsafe manner. "Failsafe" in this context means that the switching device complies at least with Safety Category 3 of European Standard EN 954-1. For example, devices like these are used to stop a machine system from which a hazard originates, or to bring it to a safe state in some other way, as a reaction to the operation of an EMERGENCY OFF button or the opening of a guard door. It is also generally necessary to disconnect a machine or machine system entirely or at least partially in a failsafe manner in order to carry out maintenance or repair work. Since a malfunction or a failure of the safety switching device in a situation like this results in an immediate personnel hazard, the failsafety of such switching devices is subject to very stringent requirements. This leads to a very high degree of complexity associated with high costs for the development and manufacture of safety switching devices.

In some applications, there is a need to run down the machine or machine system in a controlled manner before it is actually disconnected, that is to say before the removal of the supply voltage. In this case, the machine is transferred to a defined rest state in a controlled manner by the machine controller. This is particularly advantageous when the restarting of the machine after being disconnected abruptly in the middle of the operating process is associated with difficulties. Furthermore, controlled running down before the actual disconnection avoids uncontrolled machine movement, for example due to inertia forces.

In order to allow a machine to be run down in a controlled manner before it is actually switched off, a known safety switching device has a first delay element, by means of which the switching-off process, that is to say the interruption of the power supply, is delayed by the first time interval. Before this time interval has elapsed, the signaling unit produces a state change in the external reporting signal, thus causing the control unit for the machine to bring it to the rest state.

In the known safety switching devices, the signaling unit essentially comprises two mutually redundant relays which, in contrast to the relays in the disconnection unit, trip without any delay when no current flows in their control circuit. In contrast, the relays in the disconnection unit have an off delay. Like the known safety switching device in total, the signaling unit is thus designed to be failsafe and thus produces a failsafe reporting signal. As already mentioned above, however, a safety switching device like this is complex and costly.

SUMMARY OF THE INVENTION

It is thus an object of the present invention to specify a safety switching device of the type mentioned before which can be produced at a lower cost, however with maintaining the required failsafety in its overall behavior.

According to one aspect of the invention, this object is achieved by the signaling unit being a non-failsafe unit which produces a non-failsafe reporting signal at one output of the switching device.

This solution is based on the realization that the production of the reporting signal is a sub process which, if seen on its own and in contrast to the overall process of switching off the machine, is not directly safety-critical. This is because a malfunction in the production of the reporting signal will at the latest be picked up after the first time interval has elapsed due to the fact that the power supply is interrupted then. In consequence, it is possible to place less stringent requirements on the failsafety of the signaling unit without reducing the failsafety of the entire safety switching device according to the invention. If the signaling unit is not made failsafe at all, this considerably reduces the complexity, so that the safety switching device according to the invention can be produced more easily and thus at a lower cost, overall.

In contrast to completely dispensing with the signaling unit, the safety switching device according to the invention has the advantage that the machine which is to be switched off can generally be run down in a controlled manner before being switched off. This avoids difficulties during restarting.

In a preferred refinement of the invention, the signaling unit deactivates the reporting signal without any delay when the defined signal state occurs.

This means that the signaling unit causes a state change in the external reporting signal virtually at the same time as the occurrence of the defined signal state of the control signal. It goes without saying that exact time correspondence cannot be achieved in practice, owing to the technically dependent signal delay times. "Without delay" thus means that there are no additional delays in the reaction of the signaling unit beyond the unavoidable signal delay times. This measure has the advantage that the operating control system for the machine has a maximum time period available in order to run down the machine in a controlled manner. Conversely, the first time interval may be kept very short, which allows the safety switching device to react quickly, overall.

In a further refinement of the invention, the control signal includes an operating voltage for the switching device, with the defined signal state corresponding to absence of the operating voltage.

This provides additional safety, since the safety switching device initiates the switching-off process automatically when its own operating voltage is removed. In the event of a failure of the safety switching device, the monitored machine is thus run down automatically, and is switched off in a failsafe manner.

In a further refinement, the safety switching device has a logic OR gate, which links the operating voltage to an externally supplied disconnection signal of a tripping element, with the defined signal state corresponding to absence of the operating voltage or to operation of the tripping element.

This measure provides two-channel drive for the safety switching device in a simple manner, thus further increasing the failsafety.

In a further refinement of the invention, the signaling unit has a second delay element, by means of which the production of the reporting signal is delayed by a second time interval when the switching device is switched on.

This measure has the advantage that the supply voltage for the machine is already available in a stable manner before the signaling unit produces the external reporting signal and the operating control system for the machine in consequence causes the machine to run up. In this case, this advantageous time sequence can be achieved without any additional external circuitry and timers, thus simplifying the use and the installation of the safety switching device according to the invention.

In a further refinement of the invention, the disconnection unit has at least two mutually redundant switching means, which are arranged in series with one another.

This measure, which is known per se, makes it possible to make the disconnection unit failsafe in the sense of European Standard EN 954-1, so that the safety switching device according to the invention can comply with this standard, overall.

In a further refinement of the measure mentioned above, the switching means have at least one positively-guided auxiliary contact, which is connected in a monitoring circuit.

This measure results in even better failsafety, since this additionally allows the operability of the disconnection unit to be monitored.

In a further preferred refinement of the invention, the disconnection unit and the signaling unit are arranged in a common switching device enclosure.

This measure has the advantage that the safety switching device according to the invention is available as a compact component, thus considerably simplifying its installation in a machine system that is to be monitored. In this case, it is particularly advantageous that the time sequences between the disconnection unit and the signaling unit are controlled within the device, thus avoiding faults in the installation and undesirable manipulations.

It goes without saying that the features mentioned above and those which are still to be explained in the following text can be used not only in the respectively stated combination but also in other combinations or on their own, without departing from the scope of the present invention.

BRIEF DESCRIPTION OF THE DRAWINGS

Exemplary embodiments of the invention will be explained in more detail in the following description and are illustrated in the drawing, in which:

In FIG. 1, a safety switching device of a generic type is annotated in its entirety by reference number 10.

DETAILED DESCRIPTION OF PREFERRED EMBODIMENTS

Figure 1:
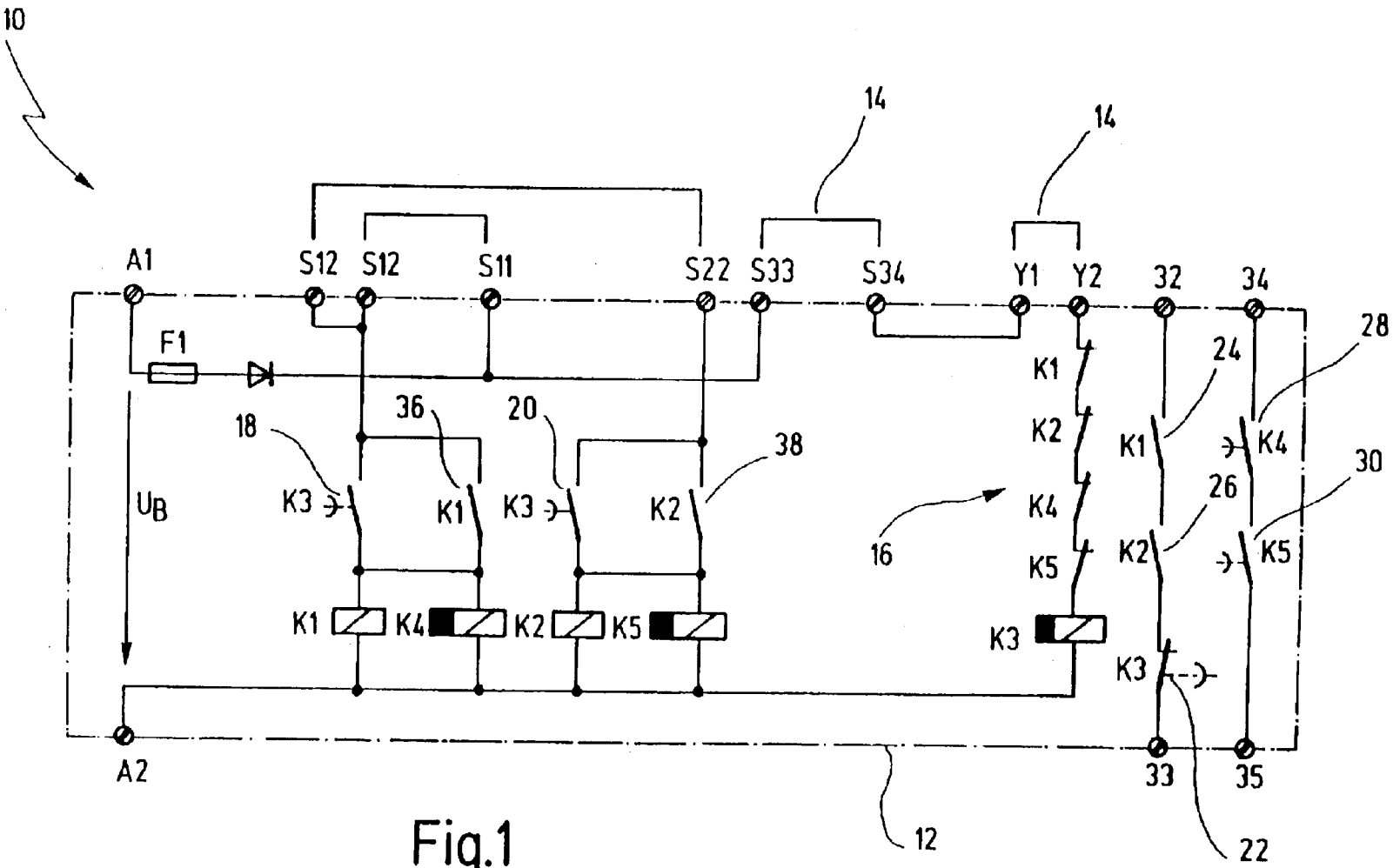
Fig.1 (PRIOR ART)
FIG. 1 shows a schematic illustration of a safety switching device of a generic type, on which the present invention is based.

The safety switching device 10 is installed in a compact device enclosure 12, which has numerous externally accessible connecting terminals. In the present exemplary embodiment, the connecting terminals are in the form of screw terminals and are indicated in FIG. 1 in the usual manner for such switching devices.

The connecting terminals A1 and A2 form an input via which the safety switching device 10 is supplied with a device-internal operating voltage $U_B$. On being switched on, the operating voltage $U_B$ is passed via external links 14 between the terminals S33 and S34, and terminals Y1 and Y2, first of all to a series circuit 16, which is formed from the auxiliary contacts of four relays K1, K2, K4 and K5 and to the control circuit of an off-delay relay K3 as well as. The auxiliary contacts of the relays K1, K2, K4 and K5 are break contacts, which are closed in the rest state. As a consequence of this, once the safety switching device 10 has been switched on, a current initially flows via the control circuit of the relay K3. Its make contacts 18, 20 then pull in, as does its auxiliary contact 22. The operating voltage $U_B$ is then passed via the make contacts 18, 20 of the relay K3 to the control circuits of the relays K1, K2, K4 and K5 already mentioned. Their make contacts 24, 26, 28, 30 form two output circuits of the safety switching device 10, which are accessible via terminals 32, 33 and 34, 35.

When the relays K1, K2, K4 and K5 pull in, their auxiliary contacts in the series circuit 16 open, and the make contacts 24, 26, 28, 30 close. Furthermore, the two further auxiliary contacts 36, 3B are closed and then maintain the current flow via the control circuits for the relays K1, K2, K4 and K5 irrespective of the operating position of the relay K3. The relay K3 trips once the predetermined off delay time has elapsed.

Once these processes have been completed, the make contacts 24, 26, 28, 30 in the two output circuits of the safety switching device 10 are closed, so that a machine (not shown here) which is connected to the safety switching device 10 is switched on. If the operating voltage $U_B$ is removed from the input terminals A1, A2, all the contacts fall back to their rest position, as illustrated in FIG. 1. This results in the current path between the terminals 32 and 33 being interrupted virtually at the same time. The current path between the terminals 34 and 35 is in contrast interrupted with a delay time, which corresponds to the off delay time of the relays K4 and K5.

During practical operation, a machine which is to be switched off is supplied via the current path between the terminals 34 and 35, while the reporting signal is passed via the current path between the terminals 32 and 33. As can be seen, the production of the reporting signal in this case requires just as many relays as for switching off the machine.

Figure 2:
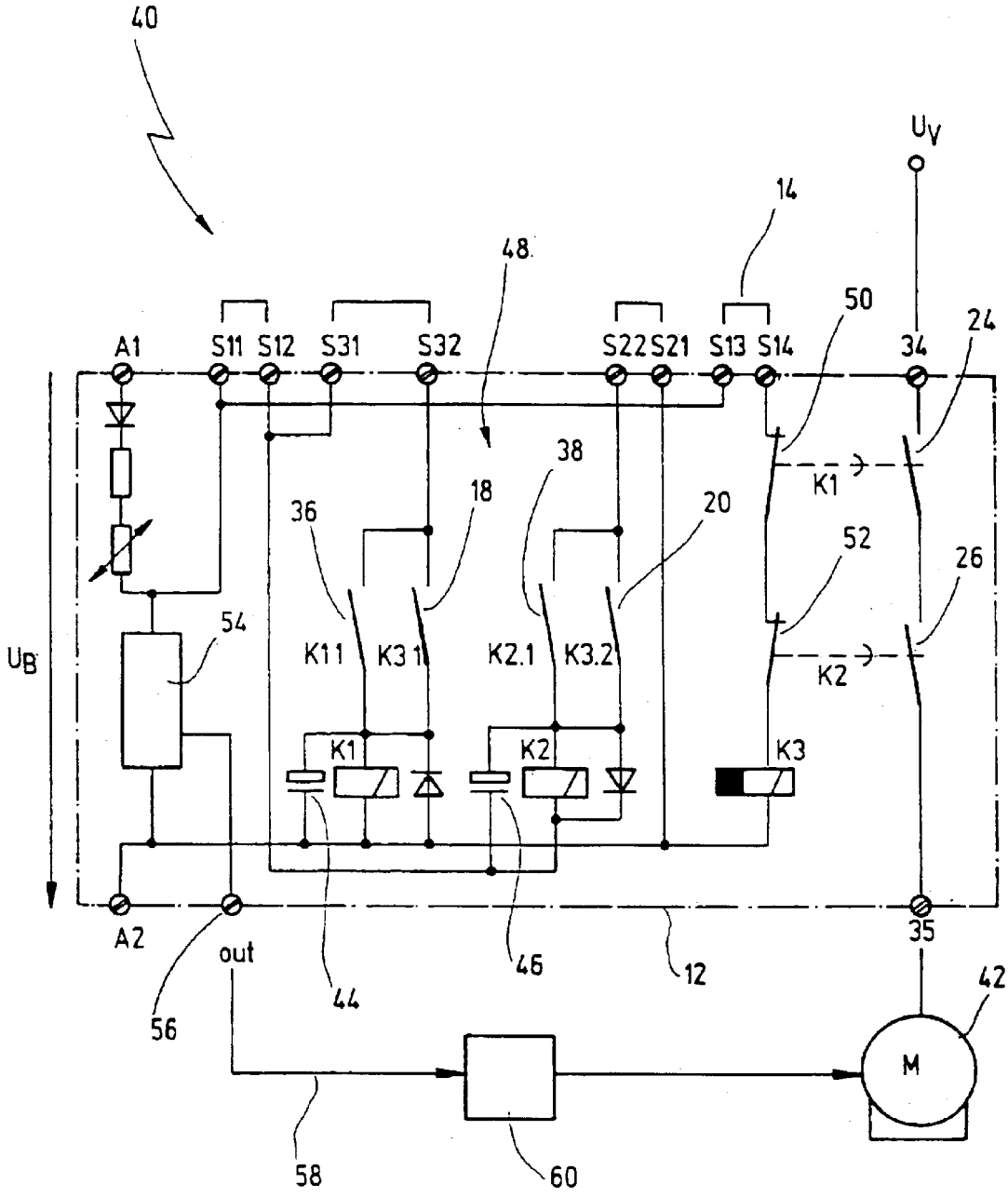
FIG. 2 shows a schematic illustration of an exemplary embodiment of the safety switching device according to the invention.

In FIG. 2, an exemplary embodiment of a safety switching device according to the invention is annotated in its entirety, with reference number 40. Identical reference symbols in this case denote the same elements as in FIG. 1.

The safety switching device 40 once again has the make contacts 24, 26 (which are arranged in series) of the two relays K1 and K2 in its output circuit between the terminals 34 and 35. The input circuits of the relays K1 and K2 are initially supplied via the make contacts 18, 20 of the relay K3, in the same way as the safety switching device 10 shown in FIG. 1. Once the relays K1 and K2 have pulled in, the relay K3 trips with a delay time, and the input circuits of the relays K1 and K2 are supplied via the auxiliary contacts 36 and 38, which are closed at this time. To this extent, the design of the safety switching device 40 corresponds to that of the safety switching device 10.

In the described state after being switched on, the current path is closed via the terminals 34, 35, and an electrical machine 42 is connected to the supply voltage $U_V$.

The reference numbers 44, 46 denote two capacitances, which are respectively connected in parallel with the control circuit of the relays K1 and K2. In the switched-on state, the two capacitances 44, 46 are charged up. When the input-side operating voltage $U_B$ is removed, the two capacitances 44, 46 are discharged via the control circuits of the relays K1 and K2. The relays K1 and K2 do not trip, with their make contacts 24, 26 opening, until after the capacitances have been discharged. The machine 42 is thus switched off with a delay time $T_1$, which corresponds to the discharge time for the capacitances 44, 46. The capacitances 44, 46 are thus first delay elements in the context of the present invention.

Those components of the safety switching device 40 which have been described so far form a disconnection unit, which is referred to in its entirety in the following text by the reference number 48. The disconnection unit 48 is here designed with two-channel redundancy in a manner known per se, thus achieving failsafety in the sense of European Standard EN 954-1. Furthermore, each of the two relays K1, K2 has a poitively-guided auxiliary contact 50, 52, which is coupled to the relay K3 such that the safety switching device 40 cannot be taken into operation if one of the make contacts 24, 26 has fused. The auxiliary contacts 50, 52 are thus included in a monitoring circuit.

In contrast to the safety switching device 10 shown in FIG. 1, however, the safety switching device 40 has a signaling unit 54 which is not failsafe and which produces a reporting signal 58, which is not failsafe, at an output terminal 56. The reporting signal 58 can thus be supplied in a simple manner to a control unit 60 for the machine 42.

In the simplest case, the output terminal 56 is connected directly to the operating voltage $U_B$ in order to produce the reporting signal 58. Preferred exemplary embodiments for the signaling unit 54 are, however, described with reference to the following figures.

Figure 3:
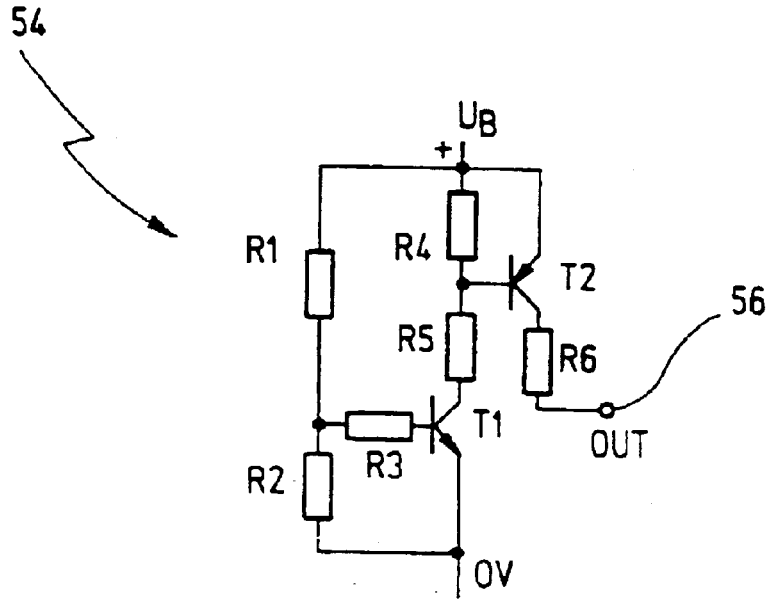
FIG. 3 shows a first exemplary embodiment of the design of the signaling unit for the safety switching device shown in FIG. 2.

In FIG. 3, the signaling unit 54 comprises an amplifier circuit comprising two transistors T1 and T2, as well as a number of resistors R1 to R6. The reporting signal 58 is in this case tapped across the resistor R6 at the collector of the transistor T2 which, with the illustrated circuitry, means that the reporting signal 58 approximately corresponds to the operating voltage $U_B$, when in the active state, while it is in a non-live, high-impedance state, when deactivated.

Figure 4:
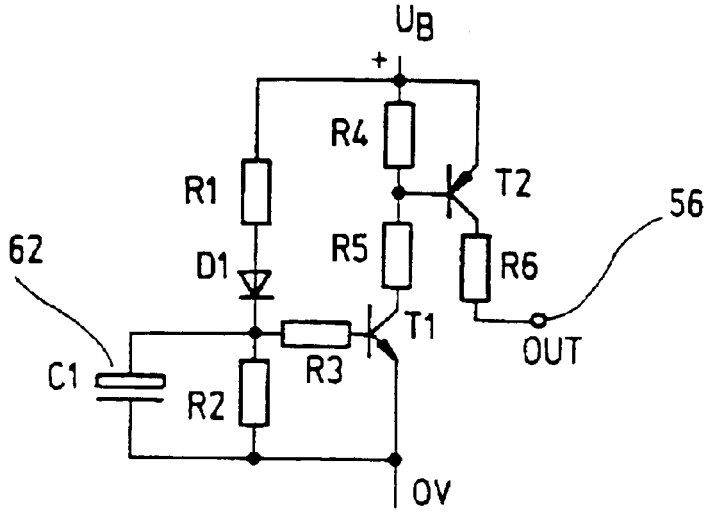
FIG. 4 shows a second exemplary embodiment of a signaling unit.

In the preferred exemplary embodiment shown in FIG. 4, the circuit of the signaling unit 54 has an additional capacitance 62 added to it, which results in the reporting signal 58 assuming its active signal state only once the capacitance 62 has been largely charged up. In consequence, when the safety switching device 40 is switched on, the production of the reporting signal 58 is delayed by a second time interval, which is governed by the capacitance 62.

Figure 5:
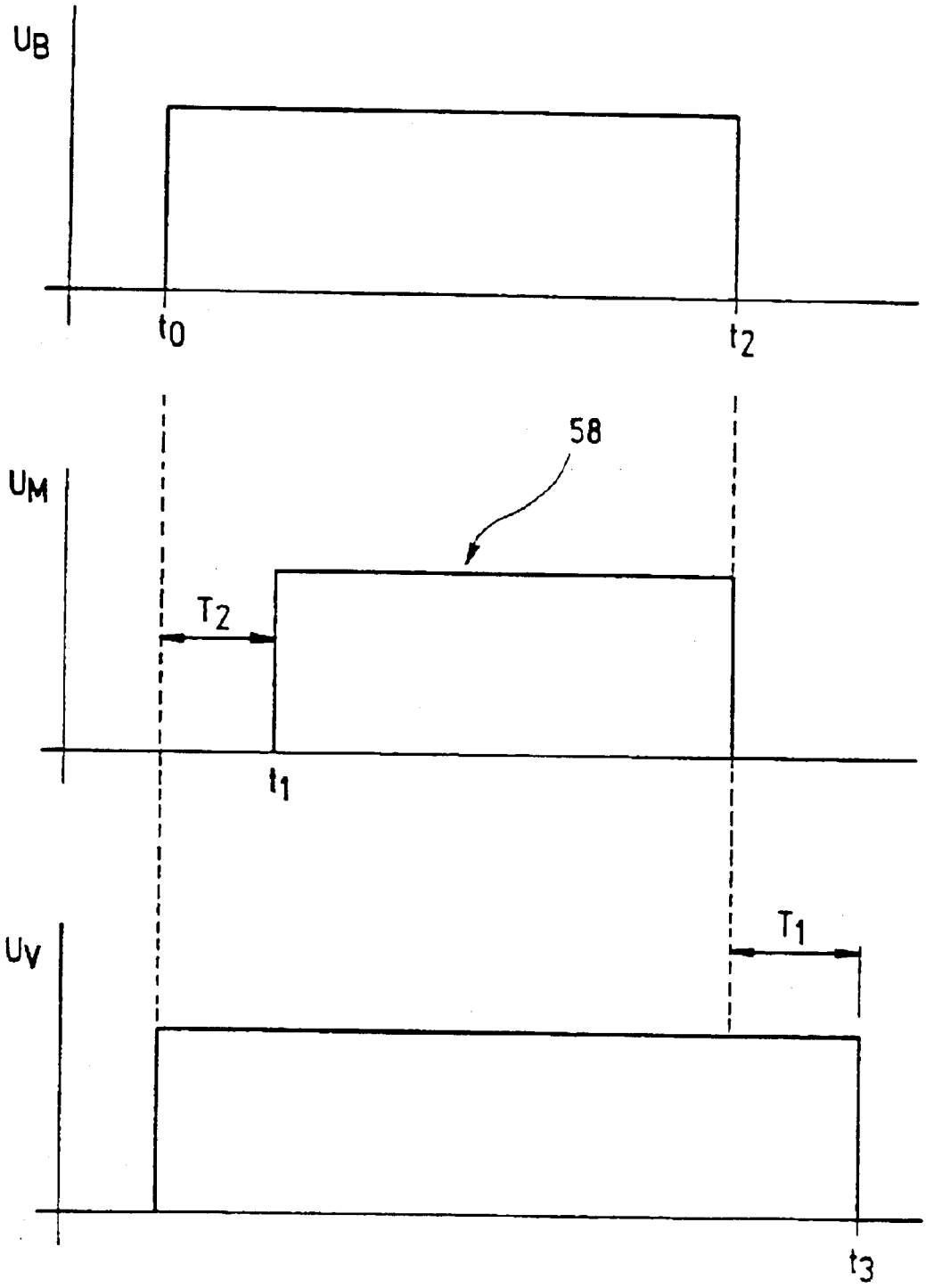
FIG. 5 shows an illustration of the time relationships in the safety switching device according to the invention.

FIG. 5 again shows the time sequences for the safety switching device 40 in the form of a graph. At the time $t_0$, the operating voltage $U_B$ of the safety switching device 40 is switched on. Virtually at the same time, the make contacts 24, 26 of the relays K1 and K2 pull in, so that the supply voltage $U_V$ is applied to the machine 42. The reporting signal 58 in contrast does not assume its active state until the second time interval $T_2$ has elapsed, which corresponds approximately to the time for charging up the capacitance 62.

If the operating voltage $U_B$ is removed from the safety switching device 40 at the time $t_2$, the reporting signal 58 reverts virtually at the same time to its deactivated, high-impedance state. However, the make contacts 24, 26 of the relays K1, K2 remain closed until the capacitances 44, 46 have been discharged. In consequence, the machine 42 is not disconnected from its power supply $U_V$ until the time interval $T_1$ has elapsed. The control unit 60 for the machine 42 thus has sufficient remaining time to run down the machine 42 in a controlled manner before switching off the supply voltage $U_V$.

Figure 6:
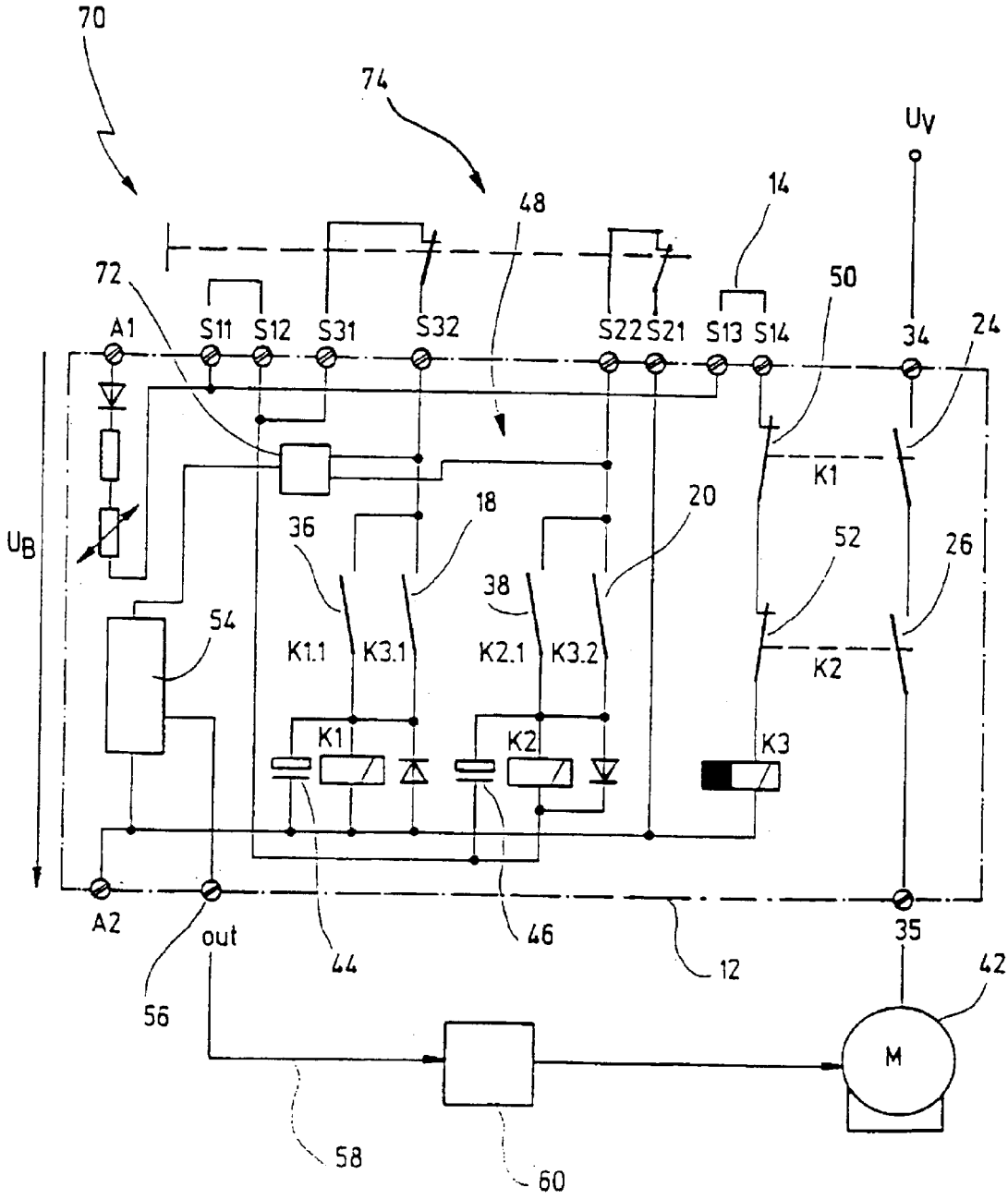
FIG. 6 shows a schematic illustration of a second exemplary embodiment of the safety switching device according to the invention.

In FIG. 6, a further exemplary embodiment of a safety switching device according to the invention is annotated in its entirety by reference number 70. The safety switching device 70 differs from the safety switching device 40 shown in FIG. 2 primarily by having a logic AND link, which is annotated by reference number 72 in FIG. 6. The output of the AND gate 72 is supplied to the signaling unit 54. The AND gate 72 receives at a first input the disconnection signal from a tripping element 74, which in this case has two channels and, by way of example, is a two-channel EMERGENCY-OFF button here. At its second input, the AND gate 72 receives a signal which is derived from the operating voltage $U_B$. The defined signal state, whose presence causes the safety switching device 70 to initiate switching off the machine 42, thus corresponds both to absence of the operating voltage $U_B$ and to operation of the tripping element 74, or even to both.

What is claimed is:

1. A machine installation having an electrical machine, a control unit for the machine, and a power supply for the machine, a tripping element for generating a control signal having at least a first and a second signal state, and a safety switching device for safely disconnecting the electrical machine as a function of the control signal, said safety switching device being separate from the machine and comprising:

an input for receiving the control signal, an output for providing a reporting signal which is supplied to the control unit, a failsafe disconnection unit for fail-safely disconnecting the machine from the power supply, and a non-failsafe signaling unit, wherein the disconnection unit and the signaling unit are jointly supplied with the control signal, wherein the signaling unit is configured to produce the reporting signal in a non-failsafe manner as a function of the first and second signal state, and wherein the disconnection unit has a first delay element, by means of which the process of disconnecting is delayed by a first time interval relative to a chance in the reporting signal.

2. The machine installation of claim 1, wherein the control signal includes an operating voltage for the switching device, with one of the first and second signal states corresponding to absence of the operating voltage.

3. The machine installation of claim 1, wherein one of the first and second signal states corresponds to operating the tripping element.

4. The machine installation of claim 1, wherein the signaling unit has a second delay element, by means of which the production of the reporting signal is delayed by a second time interval when the switching device is switched on.

5. The machine installation of claim 1, wherein the disconnection unit has at least two mutually redundant switches which are arranged in series with one another.

6. The machine installation of claim 5, wherein the safety switching device further comprises a monitoring circuit, and wherein the switches have at least one positively-guided auxiliary contact, which is part of the monitoring circuit.

7. The machine installation of claim 1, wherein the disconnection unit and the signaling unit are arranged in a common switching device enclosure.

8. A safety switching device for safely disconnecting an electrically driven machine, said switching device comprising a failsafe disconnection unit and a non-failsafe signaling unit, both of which being configured to be jointly supplied with an external control signal having at least one defined signal state, and comprising an output for providing an external reporting signal, wherein the disconnection unit is adapted to disconnect the electrically driven machine in a failsafe manner as a function of the defined signal state, wherein the disconnection unit has a first delay element, by means of which the process of disconnecting is delayed by a first time interval starting from the defined signal state, and wherein the signaling unit is adapted to produce the external reporting signal at the output in a non-failsafe manner as a function of the defined signal state.

9. The safety switching device of claim 8, wherein the signaling unit is adapted to deactivate the reporting signal without any delay when the defined signal state occurs.

10. The safety switching device of claim 8, wherein the control signal includes an operating voltage for the switching device, and wherein the defined signal state corresponds to absence of the operating voltage.

11. The safety switching device of claim 8, wherein the control signal includes an output signal from a tripping element, and wherein the defined signal state corresponds to operating the tripping element.

12. The safety switching device of claim 8, wherein the signaling unit has a second delay element, by means of which the production of the reporting signal is delayed by a second time interval when the switching device is switched on.

13. The safety switching device of claim 8, wherein the disconnection unit has at least two mutually redundant switching elements which are arranged in series with one another.

14. The safety switching device of claim 13, further comprising a monitoring circuit, wherein the switching elements have at least one positively-guided auxiliary contact, which is included in the monitoring circuit.

15. The safety switching device of claim 8, wherein the disconnection unit and the signaling unit are arranged in a common switching device enclosure.

16. A safety switching device for safely switching off an electrical load, said device having an input for receiving a control signal, a failsafe disconnection unit and a signaling unit, both units being configured to be jointly supplied with the control signal, wherein the disconnection unit is adapted to switch off the electrical load in a failsafe manner as a function of the control signal, wherein the signaling unit is configured to produce an external reporting signal as a function of the control signal, wherein the disconnection unit has a first delay element, by means of which the process of switching off the load is delayed by a first time interval, and wherein the signaling unit is a non-failsafe unit which produces the reporting signal in a non-failsafe manner.

* * * * *

UNITED STATES PATENT AND TRADEMARK OFFICE

CERTIFICATE OF CORRECTION

PATENT NO. : 6,809,911 B2
DATED : October 26, 2004
INVENTOR(S) : Rolf Dickhoff et al.

It is certified that error appears in the above-identified patent and that said Letters Patent is hereby corrected as shown below:

Column 6,
Line 59, “chance” should be -- change --.

Signed and Sealed this

Fifteenth Day of February, 2005

JON W. DUDAS
*Director of the United States Patent and Trademark Office*